US006921307B2

(12) United States Patent
Kashima et al.

(10) Patent No.: US 6,921,307 B2
(45) Date of Patent: Jul. 26, 2005

(54) EXHAUST SYSTEM FOR OUTBOARD MOTOR

(75) Inventors: Yukinori Kashima, Shizuoka (JP); Hiroyuki Tsunekawa, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/153,249

(22) Filed: May 21, 2002

(65) Prior Publication Data

US 2004/0203299 A1 Oct. 14, 2004

(30) Foreign Application Priority Data

May 21, 2001 (JP) ..... 2001-150288

(51) Int. Cl.[7] ..... B63H 21/32
(52) U.S. Cl. ..... 440/89 E; 440/88 A
(58) Field of Search ..... 440/89 R, 89 A, 440/89 E, 88 R, 88 A; 60/293, 324; 123/339.1, 339.23

(56) References Cited

U.S. PATENT DOCUMENTS

| | | | | |
|---|---|---|---|---|
| 3,552,121 A | * | 1/1971 | Kitagawa et al. | 60/310 |
| 4,177,640 A | * | 12/1979 | Kuroda et al. | 60/274 |
| 4,346,676 A | | 8/1982 | Tyner | |
| 4,475,510 A | * | 10/1984 | Asaka et al. | 123/432 |
| 4,526,002 A | * | 7/1985 | Bibow | 60/293 |
| 4,965,997 A | | 10/1990 | Suzuki et al. | |
| 5,730,632 A | * | 3/1998 | Murata et al. | 440/88 R |
| 5,761,904 A | * | 6/1998 | Nakayama | 60/293 |
| 5,865,655 A | | 2/1999 | Hiraoka et al. | |
| 5,911,608 A | | 6/1999 | Nakayama et al. | |
| 5,911,610 A | | 6/1999 | Fujimoto | |
| 5,934,960 A | | 8/1999 | Katayama et al. | |
| 5,954,022 A | | 9/1999 | Katayama et al. | |
| 6,027,385 A | | 2/2000 | Katayama et al. | |
| 6,074,258 A | | 6/2000 | Arai et al. | |
| 6,077,137 A | * | 6/2000 | Hahn | 440/89 R |
| 6,126,499 A | | 10/2000 | Katayama et al. | |
| 6,250,982 B1 | | 6/2001 | Kashima | |
| 6,283,809 B1 | | 9/2001 | Takase et al. | |

FOREIGN PATENT DOCUMENTS

| | | |
|---|---|---|
| JP | 56-44638 | 10/1981 |
| JP | 07-215294 | 8/1995 |

OTHER PUBLICATIONS

Pending Application entitled, *Air Induction System for Engine,* U.S. Appl. No. 09/906,570, filed Jul. 16, 2001, in twenty–nine (29) pages with nine (9) sheets of drawings.

* cited by examiner

*Primary Examiner*—Andrew D. Wright
(74) *Attorney, Agent, or Firm*—Knobbe, Martens, Olson & Bear, LLP

(57) ABSTRACT

An outboard motor includes a housing unit mounted on an associated watercraft. An engine is disposed above the housing unit. The engine defines a first exhaust passage communicating with a combustion chamber of the engine. The housing unit defines a second exhaust passage communicating with the first exhaust passage. The second exhaust passage communicates with outside through at least an underwater exhaust discharge port formed at a portion of the housing unit. An air intake device communicates with either the first exhaust passage or the second exhaust passage. The air intake device includes a one-way valve that allows air to enter the first or second exhaust passage and inhibits exhaust gases from moving beyond the one-way valve.

30 Claims, 9 Drawing Sheets

EXHAUST SYSTEM FOR OUTBOARD MOTOR

PRIORITY INFORMATION

This application is based on and claims priority to Japanese Patent Application No. 2001-150288, filed May 21, 2001, the entire contents of which is hereby expressly incorporated by reference.

BACKGROUND OF THE INVENTION

1. Field of the Invention

The present invention relates generally to an exhaust system for an outboard motor, and more particularly to an improved exhaust system for an outboard motor that has an exhaust discharge port at a portion of a housing unit of the outboard motor.

2. Description of Related Art

An outboard motor typically includes a housing unit that can be mounted on an associated watercraft and an engine disposed above the housing unit. The outboard motor also includes an exhaust system to discharge exhaust gases from one or more combustion chambers of the engine to a location outside of the motor. Typically, an underwater exhaust discharge port is formed at a lowermost section of the housing unit so that the exhaust gases are discharged to a body of water surrounding the outboard motor when the outboard motor is mounted to an associated watercraft. An above-water exhaust discharge port also is formed at a higher section of the housing unit to discharge exhaust gases under idle condition of the engine.

The outboard motor normally employs a propeller as a propulsion device powered by the engine. A crankshaft of the engine drives a driveshaft and a propulsion shaft coupled with the driveshaft. The propulsion shaft then drives the propeller. A transmission also is employed to change a rotational direction of the propeller among forward, neutral and reverse.

When an operator of the outboard motor shifts the transmission, for example, to the reverse direction from the forward direction, the inertia of water flow by the propeller can cause the impeller to continue to rotate in the forward direction even after the transmission has been shifted into reverse. As such, the impeller can rotate the crankshaft inversely through the driveshaft and the propeller shaft. An engine control device such as, for example, an ECU (electronic control unit) recognizes the reverse rotation of the crankshaft and controls the engine to stop. However, for a moment before the engine stops, the exhaust system can generate negative pressure. For example, if the crankshaft is rotated in the reverse direction, driving a piston downwardly while an exhaust valve is open, air will be drawn into the engine through the exhaust system. Because of this negative pressure, the underwater and above-water ports can draw water or air containing water, respectively, into the exhaust system. The water can reach the engine and can cause rust or corrosion of the engine. Particularly, if the water contains salt, the corrosion can ruin the engine faster.

SUMMARY OF THE INVENTION

A need therefore exists for an improved exhaust system for an outboard motor that can inhibit negative pressure from being generated in the exhaust system at least when the crankshaft is driven in a reverse direction.

In accordance with one aspect of the present invention, an outboard motor comprises a housing unit adapted to be mounted on an associated watercraft. An internal combustion engine is disposed above the housing unit. The engine defines a first exhaust passage communicating with a combustion chamber of the engine. The housing unit defines a second exhaust passage communicating with the first exhaust passage. The second exhaust passage communicates with outside through an exhaust discharge port formed at a portion of the housing unit. An air intake device communicates with either the first exhaust passage or the second exhaust passage. The air intake device includes a one-way valve that allows air to enter the first or second exhaust passage and inhibits exhaust gases from moving beyond the one-way valve.

In accordance with another aspect of the present invention, an outboard motor comprises a housing unit adapted to be mounted on an associated watercraft. An internal combustion engine is disposed above the housing unit. The engine includes an engine body defining a combustion chamber. An air induction system is arranged to introduce air to the combustion chamber. The air induction system includes a plenum chamber. An exhaust system is arranged to discharge exhaust gases from the combustion chamber to outside through an exhaust discharge port formed at a portion of the housing unit. An air intake device communicates with the exhaust system. The air intake device includes a one-way valve that allows air to enter the exhaust system and inhibits exhaust gases from moving beyond the one-way valve. The air intake device draws the air from the plenum chamber.

In accordance with a further aspect of the present invention, an outboard motor comprises a housing unit adapted to be mounted on an associated watercraft. An internal combustion engine is disposed above the housing unit. The engine defines a combustion chamber therein. An exhaust system is arranged to discharge exhaust gases from the combustion chamber to outside through an exhaust discharge port formed at a portion of the housing unit. Means are provided for delivering air to the exhaust system when the exhaust system generates negative pressure.

BRIEF DESCRIPTION OF THE DRAWINGS

These and other features, aspects and advantages of the present invention will now be described with reference to the drawings of preferred embodiments, which embodiments are intended to illustrate and not to limit the present invention. The drawings comprise nine figures.

DETAILED DESCRIPTION OF THE PREFERRED EMBODIMENTS OF THE INVENTION

Figure 1:
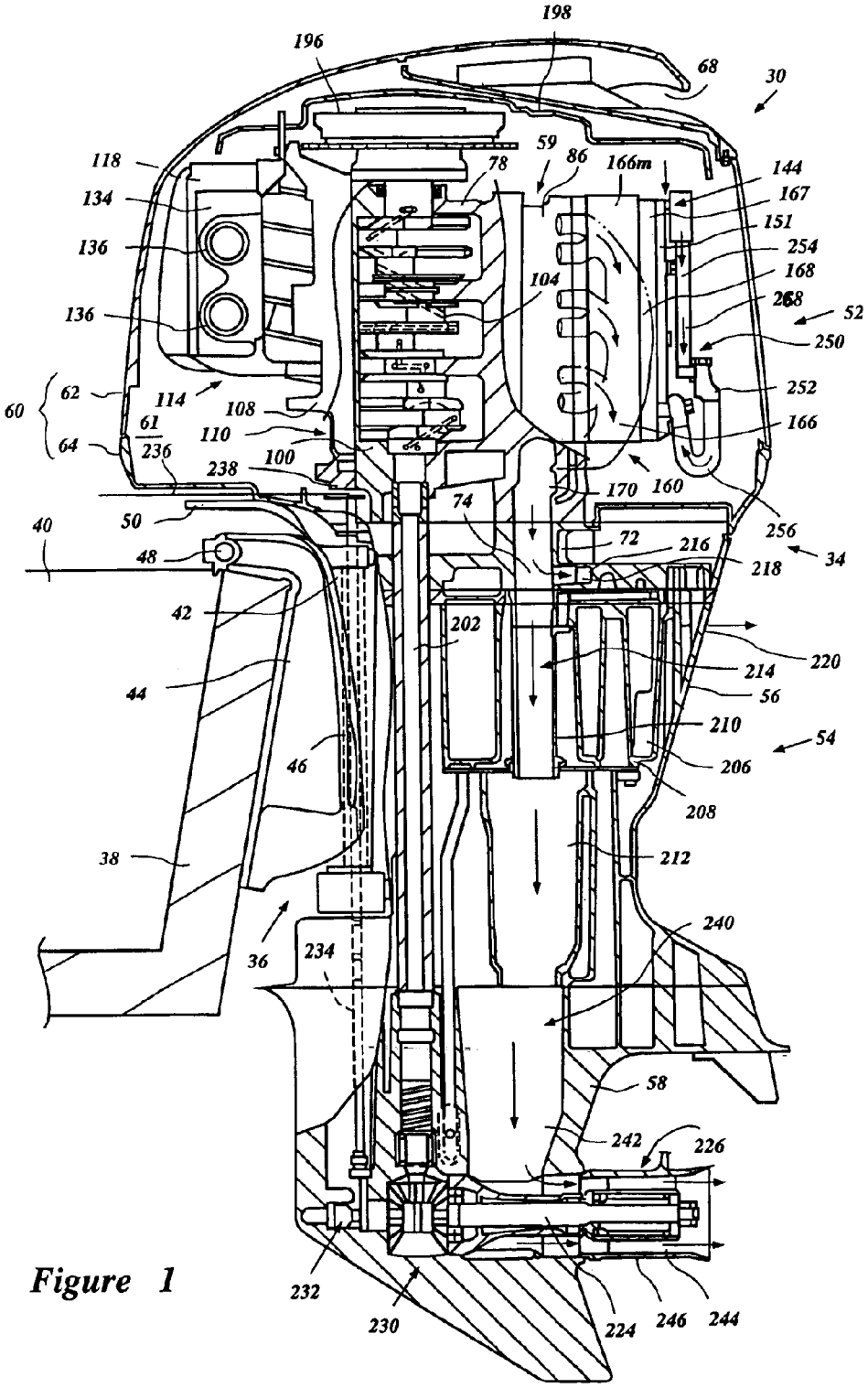
FIG. 1 is a side elevational view of an outboard motor configured in accordance with a preferred embodiment of the present invention. The outboard motor and an associated watercraft are illustrated partially in section.

With particular reference to FIG. 1, an overall construction of an outboard motor 30 configured in accordance with certain features, aspects and advantages of the present invention is described below.

In the illustrated arrangement, the outboard motor 30 comprises a drive unit 34 and a bracket assembly 36. The bracket assembly 36 supports the drive unit 34 on a transom 38 of an associated watercraft 40 and places a marine propulsion device in a submerged position with the watercraft 40 resting on the surface of a body of water. The bracket assembly 36 preferably comprises a swivel bracket 42, a clamping bracket 44, a steering shaft 46 and a pivot pin 48.

The steering shaft 46 typically extends through the swivel bracket 42 and is affixed to the drive unit 34 with upper and lower mount assemblies. The steering shaft 46 is pivotally journaled for steering movement about a generally vertically extending steering axis defined within the swivel bracket 42. A steering handle stay 50 extends forwardly atop the steering shaft 46 so that the operator can operate the steering shaft 46.

The clamping bracket 44 comprises a pair of bracket arms that are spaced apart from each other and that are affixed to the watercraft transom 38. The pivot pin 48 completes a hinge coupling between the swivel bracket 42 and the clamping bracket 44. The pivot pin 48 extends through the bracket arms so that the clamping bracket 44 supports the swivel bracket 42 for pivotal movement about a generally horizontally extending tilt axis defined by the pivot pin 48. The drive unit 34 thus can be tilted or trimmed about the tilt axis.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system not shown preferably is provided between the swivel bracket 42 and the clamping bracket 44 to tilt (raise or lower) the swivel bracket 42 and the drive unit 34 relative to the clamping bracket 44. Otherwise, the outboard motor 30 can have a manually operated system for tilting the drive unit 34. Typically, the term "tilt movement," when used in a broad sense, comprises both a tilt movement and a trim adjustment movement. The outboard motor 30 can be in a propelling position of the watercraft 40 when the drive unit 34 is in a relatively lower tilt range including the trim adjustment range with the propulsion device submerged.

The illustrated drive unit 34 comprises a power head 52 and a housing unit 54 which includes a driveshaft housing 56 and a lower unit 58. The power head 52 is disposed atop the drive unit 34 and houses an internal combustion engine 59 that is positioned within a protective cowling 60.

Preferably, the protective cowling 60 defines a generally closed cavity 61 in which the engine 59 is disposed. The protective cowling 60 preferably comprises a top cowling member 62 and a bottom cowling member 64. The top cowling member 62 preferably is detachably affixed to the bottom cowling member 64 by a coupling mechanism so that a user, operator, mechanic or repair person can access the engine 59 for maintenance or for other purposes.

The top cowling member 62 preferably defines at least one air intake opening 68 and at least one air duct disposed on its rear and top portion. Ambient air is drawn into the closed cavity 61 through the opening 68 and then through the duct. Typically, the top cowling member 60 tapers in girth toward its top surface, which is in the general proximity of the air intake opening 68.

The bottom cowling member 64 preferably has an opening at its bottom portion through which an upper portion of an exhaust guide member 72 extends. The exhaust guide member 72 preferably is made of an aluminum based alloy and is affixed atop the driveshaft housing 56. The bottom cowling member 64 and the exhaust guide member 72 together generally form a tray. The engine 59 is placed onto this tray and is affixed to the exhaust guide member 72. The exhaust guide member 72 also defines an exhaust passage 74 through which burnt charges (e.g., exhaust gases) discharged from the engine 59 moves to a next stage.

The engine 59 in the illustrated embodiment preferably operates on a four-cycle combustion principle. With continued reference to FIG. 1 and with additional reference to FIGS. 2–5, the presently preferred engine 59 has a cylinder block 78 configured as a V shape. The cylinder block 78 thus defines two cylinder banks which extend side by side with each other. In the illustrated arrangement, each cylinder bank has three cylinder bores 80 such that the cylinder block 78 has six cylinder bores 80 in total. The cylinder bores 80 of each bank extend generally horizontally and are generally vertically spaced from one another.

A piston 84 reciprocates within each cylinder bore 80. Because the cylinder block 78 is split into the two cylinder banks, each cylinder bank extends outward at an angle to an independent first end in the illustrated arrangement. Cylinder head members 86 are affixed to the respective cylinder banks to close those ends of the cylinder bores 80. The cylinder head members 86, together with the associated pistons 84 and cylinder bores 80, preferably define six combustion chambers 94. Cylinder head cover members 96 are affixed to the cylinder head members oppositely to the cylinder block 78.

A crankcase member 100 closes the other ends of the cylinder bores 80 and, together with the cylinder block 78, defines a crankcase chamber. A crankshaft 104 extends generally vertically through the crankcase chamber and can be journaled for rotation by several bearing blocks. Connecting rods 106 couple the crankshaft 104 with the respective pistons 84 in any suitable manner. Thus, the reciprocal movement of the pistons 84 rotates the crankshaft 104. A crankcase cover member 108 is affixed to the crankcase member 100 oppositely to the cylinder block 78.

In the illustrated arrangement, generally, the cylinder block 78, the cylinder head members 86, the cylinder head cover members 96, the crankcase member 100 and the crankcase cover member 108 together define an engine body 110. Preferably, at least these major engine portions 78, 86, 96, 100, 108 are made of aluminum alloy.

The engine 59 also comprises an air induction system 114. The air induction system 114 draws air from within the cavity 61 to the combustion chambers 94. The air induction system 114 preferably comprises six intake passages 116 and a pair of plenum chambers 118. In the illustrated arrangement, each cylinder bank is allotted with three intake passages 116 and one plenum chamber 118.

The most-downstream portions of the intake passages 116 are defined within the cylinder head members 86 as inner intake passages 120. The inner intake passages 120 communicate with the combustion chambers 94 through intake ports, which are formed at inner surfaces of the cylinder head members 86. Typically, each of the combustion chambers 94 has one or more intake ports. Intake valves 124 are slideably disposed at each cylinder head member 86 to move between an open position and a closed position. When each intake valve 124 is in the open position, the inner intake passage 120 that is associated with the intake port communicates with the associated combustion chamber 94.

Outer portions of the intake passages 116, which are disposed outside of the cylinder head members 86, preferably are defined with intake manifolds 128, throttle bodies 130 and intake runners 132. Those members 128, 130, 132 extend forwardly along respective side surfaces of the engine body 110.

Each throttle body 130 preferably includes a throttle valve. The operator can control the opening degree of the throttle valves through a control linkage. The throttle valves regulate amounts of air that flow through the intake passages 116 to the combustion chambers 94 in accordance with the opening degree. Normally, the greater the opening degree, the higher the rate of airflow and the greater the power output from the engine 59.

The respective plenum chambers 118 preferably are defined with plenum chamber units 134 which are disposed side by side in front of the crankcase cover member 108. Both the plenum chamber units 134 are coupled with each other with connecting pipes 136. Each plenum chamber unit 134 defines an air inlet (not shown) through which the air in the cavity 61 is drawn into the plenum chamber 118. The plenum chambers 118 coordinate air delivered to each intake passage 116 and also act as silencers to reduce intake noise. In other words, the chambers 118 act to reduce the pulsation energy within the intake system and to smooth the airflow being introduced to the engine.

In the illustrated embodiment, the throttle valves are substantially closed to bring the engine 59 to idle speed and to maintain this speed. Preferably, the valves are not fully closed such that the likelihood of throttle valve sticking can be reduced. As used throughout the description, the term "idle speed" generally means a low engine speed that is achieved when the throttle valves are closed but also includes a state in which the valves are slightly opened to allow a small level of airflow through the intake passages 116. Also, the outboard motor 30 is often used for trolling, which is a very low speed, generally forward movement of the watercraft. Thus, when trolling, a shift mechanism, which will be described later, is in a forward position and the engine 59 operates in the idle speed.

Figure 4:
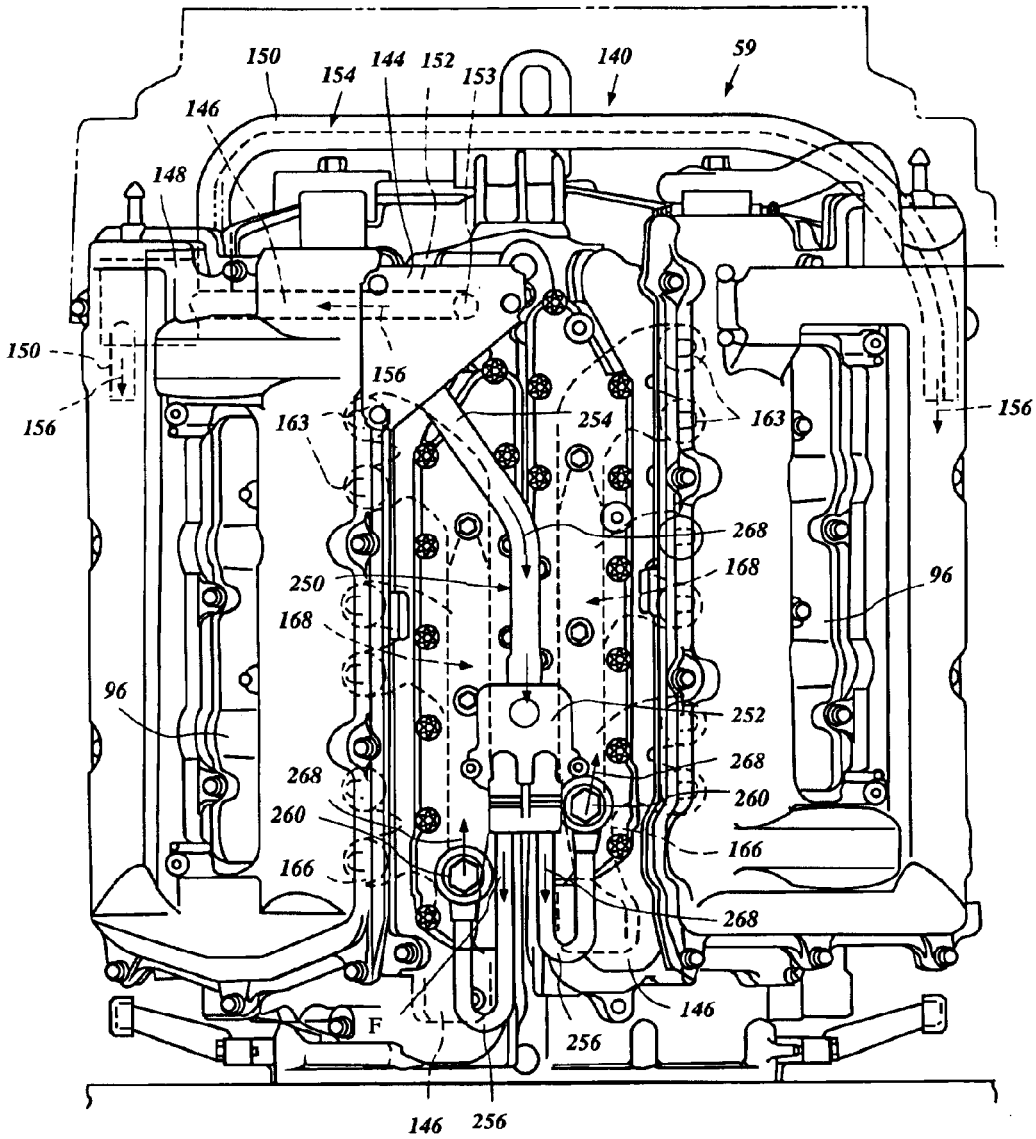
FIG. 4 is a rear view of the engine.
Figure 5:
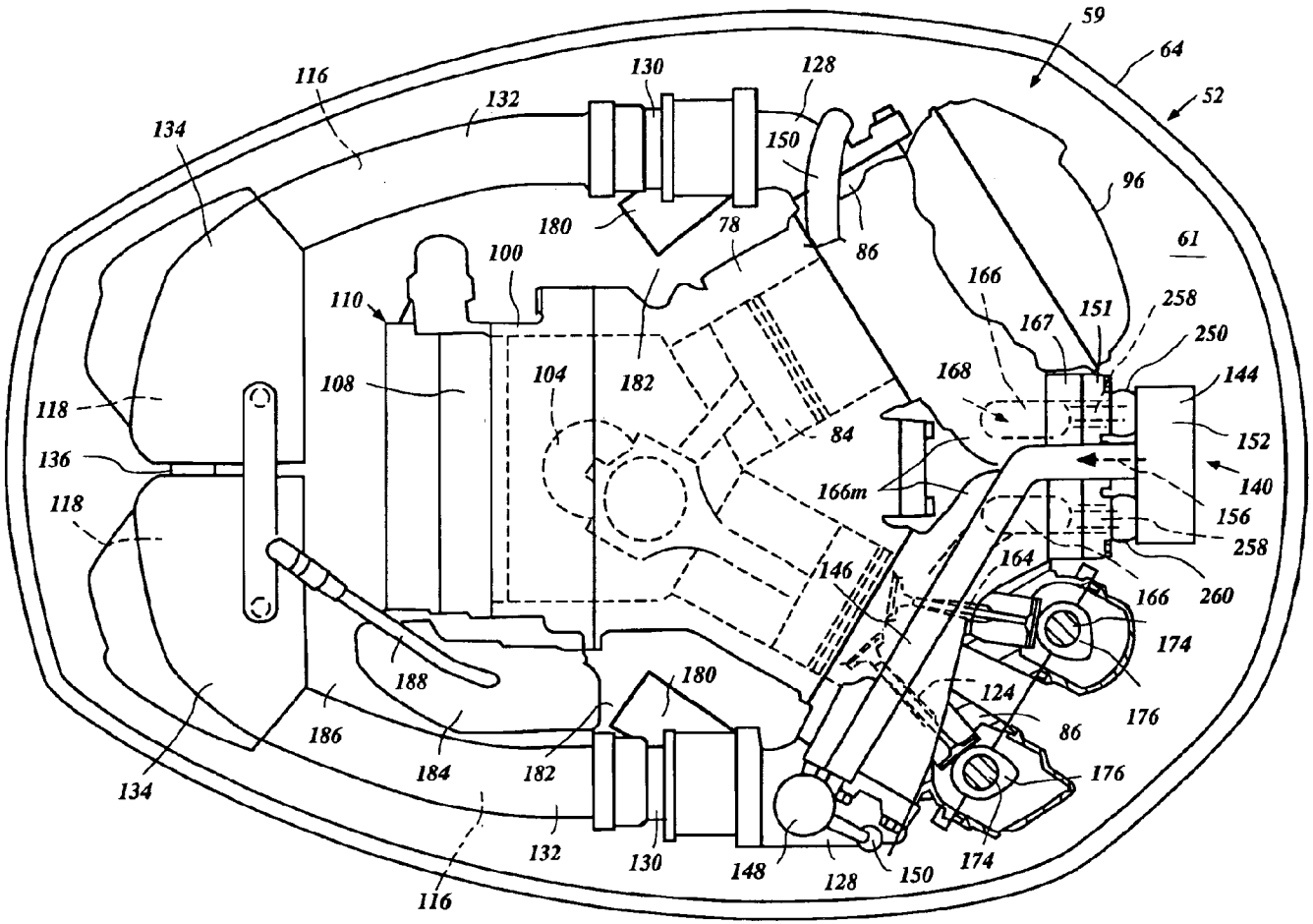
FIG. 5 is another top plan view of the power head to show an air intake device. The top cowling member is detached. The engine is illustrated partially in section.

With particular reference to FIGS. 4 and 5, the illustrated air induction system 114 preferably includes a secondary air delivery unit or idle speed control (ISC) mechanism 140 that can deliver idle air to the combustion chambers 94 when the throttle valves are substantially closed. In this arrangement, the intake passages 116 and the plenum chambers 118 together define a primary air delivery unit.

The secondary unit or ISC mechanism 140 preferably comprises a secondary plenum chamber member 144, an upstream conduit 146, an ISC device 148 and a pair of downstream conduits 150.

Preferably, the secondary plenum chamber member 144 is generally disposed atop a recessed portion defined by the two banks and affixed to the cylinder head cover member 96 on the bank located on the port side and an outer exhaust cover member 151. FIG. 5 schematically illustrates a location of the secondary plenum chamber member 144 rather than an actual location thereof. The secondary plenum chamber member 144 defines a secondary plenum chamber 152 that acts as an air coordinator and a silencer similarly to the primary plenum chambers 118. An air inlet 153 is formed to draw the air in the cavity 61 to the secondary plenum chamber 152.

The upstream conduit 146 defines an upstream passage connecting the secondary plenum chamber 152 with the ISC device 148. The ISC device 148 contains an ISC valve that is controlled by an ECU (not shown) to open when the throttle valves in the primary unit are closed or almost closed. The downstream conduits 150 define downstream passages connecting the ISC device 148 with the respective intake manifolds 128 which locate downstream of the throttle valves. The upstream and downstream conduits 146, 150 together define a bypass conduit assembly 154 because air under idle condition can bypass the throttle valves to the combustion chambers 94 through the bypass conduit assembly 154. The air drawn into the secondary plenum chamber 152 moves to the intake manifolds 128 through the bypass conduit assembly 154 and the ISC device 148 as indicated by the arrows 156 of FIGS. 4 and 5.

The secondary air delivery unit 140 is disclosed in, for example, a co-pending U.S. application filed Jul. 16, 2001, titled AIR INDUCTION SYSTEM FOR ENGINE, which Ser. No. is 09/906,570, the entire contents of which is hereby expressly incorporated by reference.

The engine 59 comprises an exhaust system 160 that routes burnt charges, i.e., exhaust gases, to a location outside of the outboard motor 30. Each cylinder head member 86 defines a set of inner exhaust passages 162 (FIG. 3) that communicate with the combustion chambers 94 through one or more exhaust ports 163, which may be defined at the inner surfaces of the respective cylinder head members 86. Exhaust valves 164 are slideably disposed at each cylinder head member 86 to move between an open position and a closed position. When each exhaust valve 164 is in the open position, the inner exhaust passage 162 that is associated with the exhaust port 163 communicates with the associated combustion chamber 94.

Figure 2:
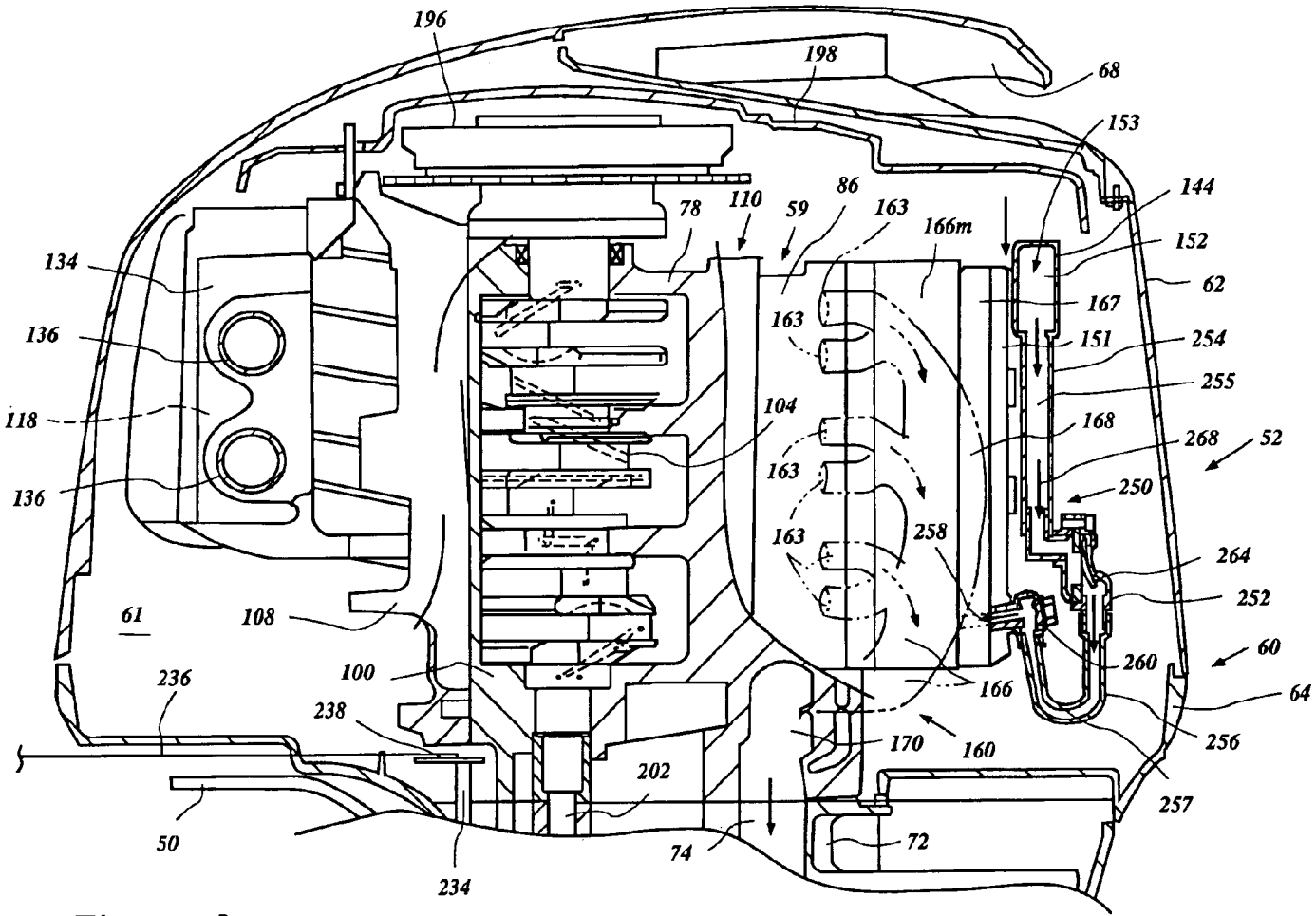
FIG. 2 is an enlarged side elevational and partial section view of the outboard motor shown in FIG. 1 to show a power head and particularly an engine of the outboard motor.
Figure 3:
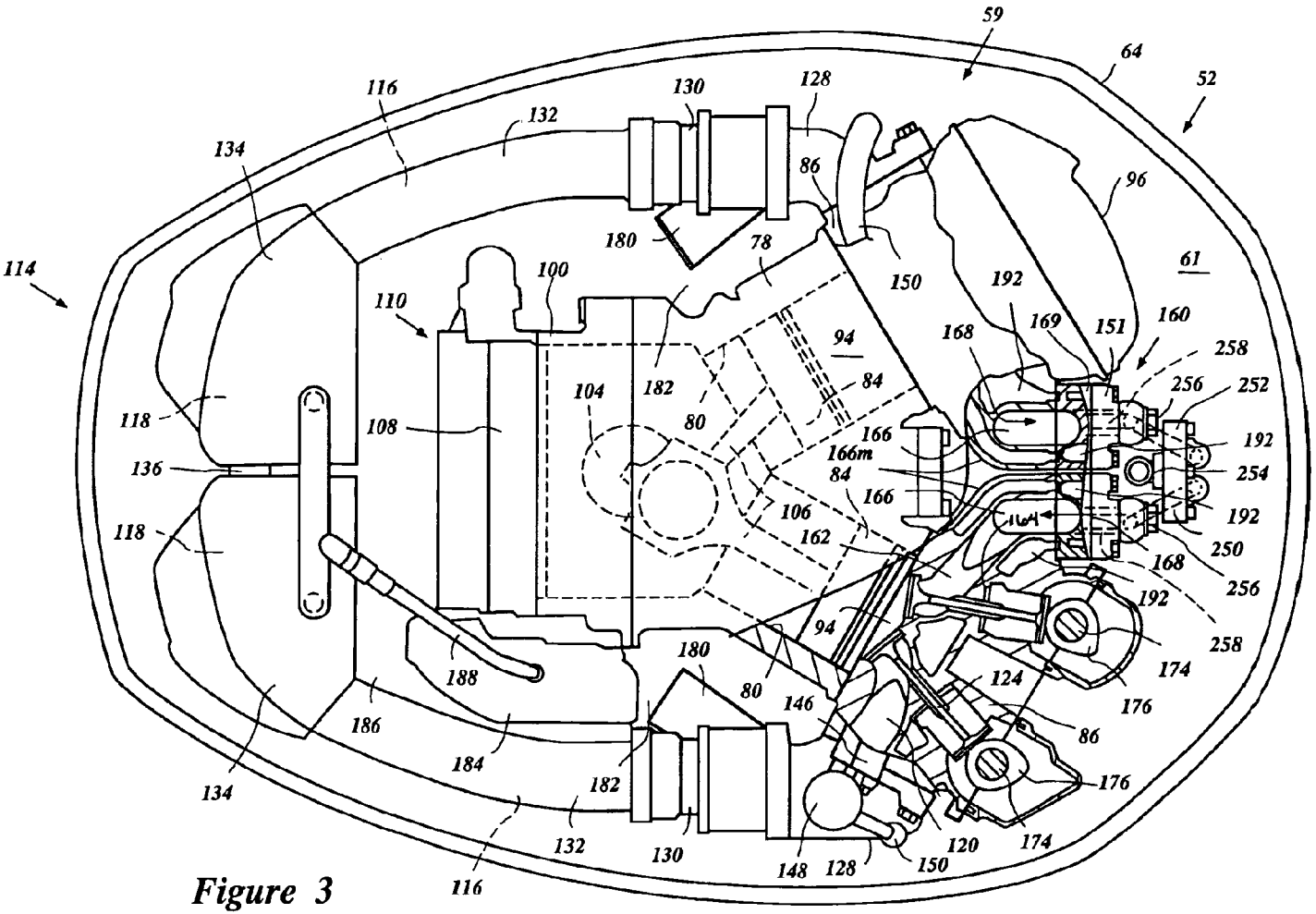
FIG. 3 is a top plan view of the power head. A top cowling member is detached. The engine is illustrated partially in section.

Exhaust manifold passages 166 preferably are defined generally vertically by the respective cylinder head members 86 with inner exhaust cover members 167. In other words, exhaust manifolds **166*m* in this arrangement are unitarily formed with the cylinder head members 86. FIGS. 1 and 2 schematically illustrate the exhaust manifold passages 166 in phantom line and part thereof is out of the cylinder head members 86. The exhaust manifold passages 166 communicate with the combustion chambers 94 through the inner exhaust passages 162 and the exhaust ports 163 to collect exhaust gases therefrom. Two of the exhaust manifold passages 166 define one exhaust manifold passage unit 168. The exhaust manifold passage unit 168 is unified together within the cylinder block 78 to form a single exhaust passage section 170. The exhaust passage section 170 in turn is coupled with the exhaust passage 74 of the exhaust guide member 72. Thus, when the exhaust ports 163 are opened, the combustion chambers 94 communicate with the exhaust passage 74 through the exhaust manifold passages 166, i.e., exhaust manifold passage unit 168, and the exhaust passage section 170**.

A valve cam mechanism preferably is provided for actuating the intake and exhaust valves 124, 164 in each cylinder bank. Preferably, the valve cam mechanism includes two camshafts 174 per cylinder bank. The camshafts 174 extend generally vertically and are journaled for rotation relative to the cylinder head members 86. The camshafts 174 have cam lobes 176 to push valve lifters that are affixed to the respective ends of the intake and exhaust valves 124, 164 in any suitable manner. The cam lobes 176 repeatedly push the valve lifters in a timed manner, which is in proportion to the engine speed. The movement of the lifters generally is timed by rotation of the camshafts 174 to appropriately actuate the intake and exhaust valves 124, 164.

A camshaft drive mechanism (not shown) preferably is provided for driving the valve cam mechanism. Thus, the intake and exhaust camshafts 174 comprise intake and exhaust driven sprockets positioned atop the intake and exhaust camshafts 174, respectively, while the crankshaft 104 has a drive sprocket positioned atop thereof. A timing chain or belt is wound around the driven sprockets and the drive sprocket. The crankshaft 104 thus drives the respective camshafts 174 through the timing chain in the timed relationship. Because the camshafts 174 must rotate at half of the speed of the rotation of the crankshaft 104 in a four-cycle engine, a diameter of the driven sprockets is twice as large as a diameter of the drive sprocket.

The engine 59 preferably has indirect, port or intake passage fuel injection system. The fuel injection system preferably comprises six fuel injectors 180 with one fuel injector allotted for each one of the respective combustion chambers 94. The fuel injectors 180 preferably are mounted on the throttle bodies 130 and a pair of fuel rails connects the respective fuel injectors 180 with each other on each cylinder bank. The fuel rails also define portions of the fuel conduits to deliver fuel to the injectors 180. In this arrangement, the fuel injectors and the fuel rails are positioned in spaces 182 formed between the engine body 110 and the throttle bodies 130.

Each fuel injector 180 preferably has an injection nozzle directed downstream within the associated intake passage 116, which is downstream of the throttle valve and within the intake manifold 128. The fuel injectors 180 spray fuel into the intake passages 116 under control of the ECU. The ECU controls both the initiation timing and the duration of the fuel injection cycle of the fuel injectors 180 so that the nozzles spray a proper amount of fuel each combustion cycle.

Typically, a fuel supply tank disposed on a hull of the associated watercraft 40 contains the fuel. The fuel is delivered to the fuel rails through the fuel conduits and at least one fuel pump, which is arranged along the conduits. The fuel pump pressurizes the fuel to the fuel rails and finally to the fuel injectors 180. A vapor separator 184 preferably is disposed in a space 186 formed between the engine body 110 and the intake runners 132 on the port side. The vapor separator 184 separates vapor from the fuel therein and sends the vapor to the plenum chambers 118 through a vapor delivery conduit 188. The vapor thus can be delivered to the combustion chambers 94 through the plenum chambers 118 together with the air for combustion. A direct fuel injection system that sprays fuel directly into the combustion chambers can replace the indirect fuel injection system described above. Moreover, other charge forming devices, such as carburetors, can be used instead of the fuel injection systems.

The engine 59 further comprises an ignition or firing system (not shown). Each combustion chamber 94 is provided with a spark plug (not shown) which preferably is disposed between the intake and exhaust valves 124, 164. Each spark plug has electrodes that are exposed into the associated combustion chamber 94 and that are spaced apart from each other with a small gap. The spark plugs generate a spark between the electrodes to ignite an air/fuel charge in the combustion chamber 94 at selected ignition timing under control of the ECU.

In the illustrated engine 59, the pistons 84 reciprocate between top dead center and bottom dead center. When the crankshaft 104 makes two rotations, the pistons 84 generally move from the top dead center position to the bottom dead center position (the intake stroke), from the bottom dead center position to the top dead center position (the compression stroke), from the top dead center position to the bottom dead center position (the power stroke) and from the bottom dead center position to the top dead center position (the exhaust stroke). During the four strokes of the pistons 84, the camshafts 174 make one rotation and actuate the intake and exhaust valves 124, 164 to open the intake ports and the exhaust ports 163 during the intake stroke and the exhaust stroke, respectively.

Generally, during the intake stroke, air is drawn into the combustion chambers 94 through the air intake passages 116 and fuel is injected into the intake passages 116 by the fuel injectors 180. The air and the fuel thus are mixed to form the air/fuel charge in the combustion chambers 94. Slightly before or during the power stroke, the respective spark plugs ignite the compressed air/fuel charge in the respective combustion chambers 94. The air/fuel charge thus rapidly bums during the power stroke to move the pistons 84. The burnt charge, i.e., exhaust gases, then are discharged from the combustion chambers 94 during the exhaust stroke.

The engine 59 may comprise a cooling system, a lubrication system and other systems, mechanisms or devices in addition to the systems described above. For example, water jackets 192 of the cooling system are formed within the cylinder head members 86 and the inner and outer exhaust cover members 167, 151 in proximity to the exhaust manifold passages 166.

A flywheel assembly 196 preferably is positioned atop the crankshaft 104 and is mounted for rotation with the crankshaft 104. The flywheel assembly 198 comprises a flywheel magneto or AC generator that supplies electric power to various electrical components, such as the fuel injection system, the ignition system and the ECU. A protector 198 covers at least the engine body 110, the flywheel assembly 196 and the camshaft drive mechanism.

With particular reference to FIG. 1, the driveshaft housing 56 is positioned below the exhaust guide member 72. A driveshaft 202 preferably extends generally vertically through an opening formed at forward portions of the engine body 110, the exhaust guide member 72 and the driveshaft housing 56 to be coupled with the crankshaft 104 at a bottom portion of the engine body 110. The driveshaft 202 is journaled for rotation in the driveshaft housing 56 and is driven by the crankshaft 104.

A top portion of the driveshaft housing 56 preferably defines a lubricant reservoir 206 together with the lower surface of the exhaust guide member 72 for the lubrication system. The illustrated reservoir 206 is unitarily formed with internal wall portions 208 of the driveshaft housing 56.

The illustrated driveshaft housing 56 also defines internal exhaust sections with the internal wall portions 208 and an exhaust conduit 210. The exhaust conduit 210 depends from the exhaust guide member 72 to form an exhaust passage communicating with the exhaust passage 74 of the exhaust guide member 72. The illustrated exhaust conduit 210 extends generally vertically through the lubricant reservoir 206. Below the lubricant reservoir 206, the internal wall portions 208 forms a first expansion chamber 212 communicating with the exhaust passage of the exhaust conduit 210. The exhaust passage 74 of the exhaust guide member 72, the exhaust passage of the exhaust conduit 210 and the expansion chamber 12 together define a first section 214 of a primary exhaust pathway in this arrangement.

In the illustrated arrangement, the exhaust guide member 72 and the internal wall portions 208 of the driveshaft housing 56 also define an idle exhaust pathway 216. The idle exhaust pathway 216 is branched off from the first section 214 of the primary exhaust pathway at an idle exhaust inlet 218 formed within the exhaust guide member 72 and communicates with the atmosphere through an above-water "aerial" or exhaust discharge port 220 formed at an upper rear portion of the driveshaft housing 56. One or more expansion chambers can be formed between the idle exhaust inlet 218 and the aerial discharge port 220. The aerial exhaust discharge port 220 is, because of its own location, not submerged regardless of any positions of the drive unit 34.

With continued reference to FIG. 1, the lower unit 58 depends from the driveshaft housing 56 and journals a propulsion shaft 224, which is driven by the driveshaft 202. The propulsion shaft 224 extends generally horizontally through the lower unit 58. A propulsion device is attached to the propulsion shaft 224 to be driven by the propulsion shaft 224. In the illustrated arrangement, the propulsion device includes a propeller 226 affixed to an outer end of the propulsion shaft 224. The propulsion device, however, can take the form of a dual counter-rotating system, a hydrodynamic jet, or any of a number of other suitable propulsion devices.

A transmission 230 preferably is provided between the driveshaft 202 and the propulsion shaft 224. The transmission 230 couples together the two shafts 202, 224 which lie generally normal to each other (i.e., at a 90° shaft angle) with bevel gears. A switchover clutch 232 allows the transmission 230 to change the rotational direction of the propeller 226 among forward, neutral or reverse. A shifter shaft 234 extends upwardly from the switchover clutch 232 through the steering shaft 46. A shifter cable 236 is coupled with the shifter shaft 234 via a slider 238 and extends forwardly. The operator can operate the switchover clutch 232 through the shifter cable 236 and the shifter shaft 234 to shifth the transmission 230 among the forward, neutral and reverse positions.

The lower unit 58 and the propeller 226 together define a second section 240 of the primary exhaust pathway. A second expansion chamber 242 occupies major volume of the section 240 and is formed above a space where the propulsion shaft 224 extends. The second expansion chamber 242 communicates with the first expansion chamber 212 and with an underwater exhaust discharge port 244 defined at the hub 246 of the propeller 226 as part of the second section 240. The primary exhaust pathway comprising the first and second sections 214, 240 thus is submerged when the outboard motor 30 is in a propelling position of the watercraft 40.

At engine speeds above idle, the exhaust gases coming from the engine 59 descend the exhaust passage 74 of the exhaust guide member 72, the exhaust passage of the exhaust conduit 210, the first and second expansion chambers 212, 242 and then go out to the body of water through the discharge port 244 of the propeller 226. Because the gases expand and contract twice within the first and second expansion chambers 212, 242, exhaust noise is sufficiently reduced.

At idle speed, the exhaust gases go to the idle exhaust pathway 216 through the idle exhaust inlet 218 and are discharged through the aerial discharge port 220. The difference in the locations of the discharges accounts for the differences in pressure at locations above the waterline and below the waterline. Because the opening above the waterline, i.e., the aerial discharge port 220, is smaller, pressure develops within the lower unit 58. When the pressure exceeds the higher pressure found below the waterline, the exhaust gases exit through the underwater discharge port 244. If the pressure remains below the pressure found below the waterline, the exhaust gases exit through the idle exhaust pathway 216 above the waterline.

With reference to FIGS. 1–5, an air intake device 250 is described below. 100641 When the operator shifts the transmission 230, for example, to the reverse direction from the forward direction with switchover clutch 232, the inertia of water flow by the propeller 226 can rotate the crankshaft 104 inversely through the driveshaft 202 and the propeller shaft 224. The ECU recognizes the inverse rotation of the crankshaft 104 and ceases the engine operation by stopping fuel injection or by stopping the ignition. However, as the crankshaft rotates in the reverse direction, due to the downward movement of a piston during what would otherwise be an "exhaust stake," the exhaust system 160 can generate negative pressure. Because of this negative pressure, the underwater and aerial discharge ports 244, 220 can draw water or air containing water, respectively, into the exhaust system 160. The air intake device 250 is provided to overcome the negative pressure within the exhaust system 160 and preferably is formed and arranged to guide air from the cavity 61 of the protective cowling 60 into the exhaust system 160.

The illustrated air intake device 250 employs the secondary plenum chamber member 144 as an air inlet. Alternatively, one of the primary plenum chamber members 134 can replace the secondary plenum chamber member 144. Otherwise, the top cowling member 62 can define the air inlet at any portion thereof to directly intake ambient air out of the protective cowling 60.

A one-way valve unit 252 preferably is disposed between the cylinder banks and is affixed to the outer exhaust cover member 151. A single upstream air conduit 254 defines an air passage 255 (FIG. 2) connecting the secondary plenum chamber 152 and an inner cavity of the one-way valve unit 252. A pair of downstream air conduits 256, in turn, define air passages 257 connecting the one-way valve unit 252 and inner air passages 258 which are formed within the outer and inner exhaust cover members 151, 167 and communicate with the exhaust manifold passages 166. Joints 260 preferably are used for coupling the downstream air conduits 256 with the outer exhaust cover members 151. The upstream air conduit 254 and the downstream air conduits 256 preferably are made of an elastic or flexible material such as rubber.

The one-way valve unit 252 preferably contains a reed valve 264 (FIG. 2). The reed valve 264 is positioned within the unit 252 to allow air from the secondary plenum chamber 152 to enter the exhaust manifold passages 166 and to inhibit the exhaust gases within the exhaust manifold passages 166 from going out.

Part of the air in the secondary plenum chamber 152 thus moves to the exhaust manifold passages 166, i.e., the exhaust system 160, as indicated by the arrows 268 of FIGS. 1, 2 and 4. Meanwhile, the exhaust gases in the exhaust manifold passages 166, i.e., the exhaust system 160, are blocked from moving beyond the one-way valve unit 252. Accordingly, the negative pressure, even if generated in the exhaust system 160, is overcome by the entering air. Because no exhaust gases go out to the closed cavity 61, the air in this cavity 61 can be kept clean.

The air intake device 250 draws air from the plenum chamber 152 (the plenum chamber 118 in an alternative arrangement). Moisture, oily air, or dust within the closed cavity 61, if any, is prevented from directly entering the exhaust system 160.

Because of being connected to the exhaust manifold passages 166, the downstream air passages 257 are located relatively adjacent to the respective exhaust ports 163 in comparison with other locations such as connected to the exhaust passage section 170 of the cylinder block 78 or the exhaust passage 74 of the exhaust guide member 72. That is, the air intake device 250 is positioned in the close proximity to the respective combustion chambers 94 which are source of the negative pressure. Response speed thus is faster than those in other arrangements.

Figure 6:
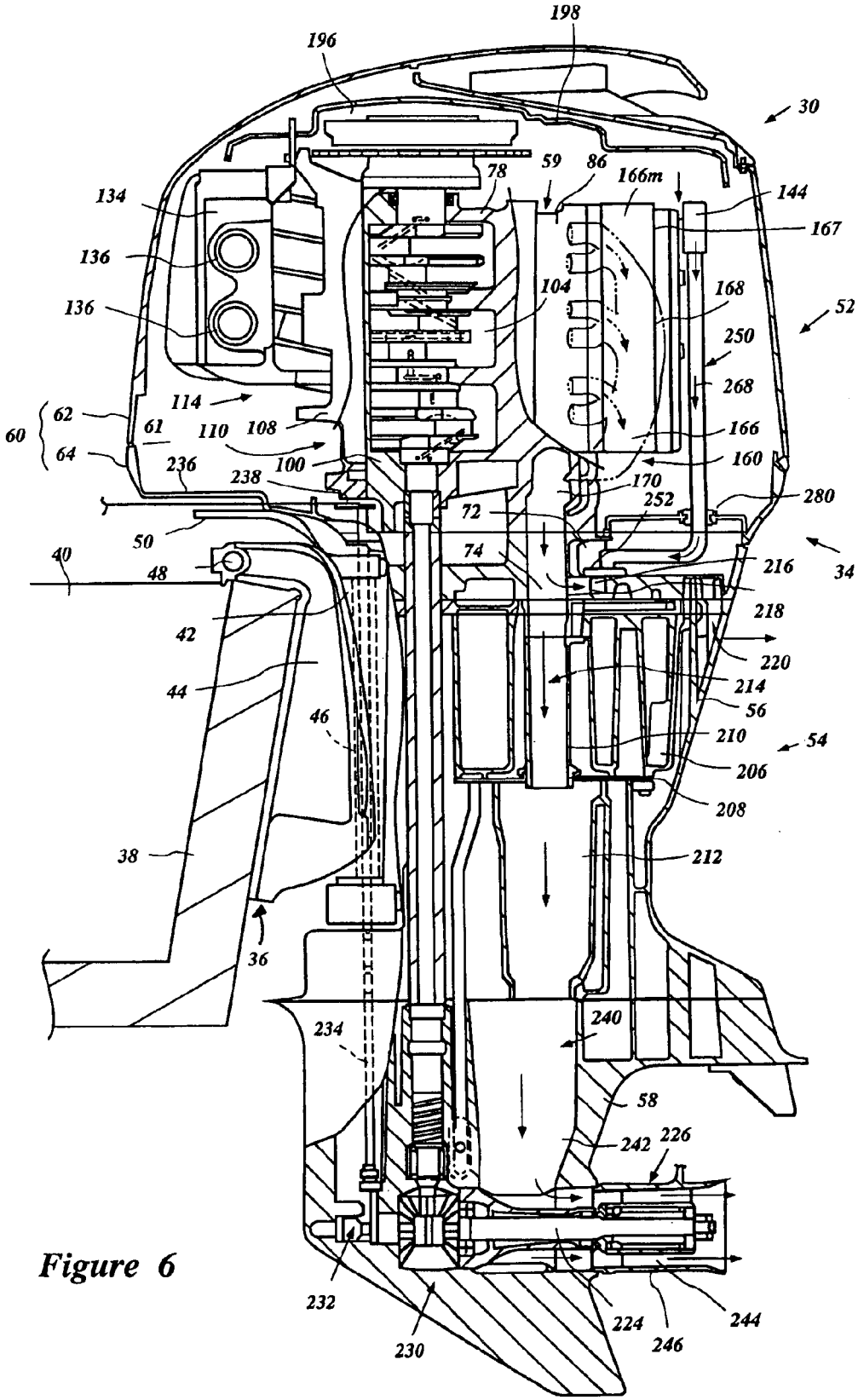
FIG. 6 is a side elevational view of a modified outboard motor configured in accordance with a second preferred embodiment of the present invention. The outboard motor and an associated watercraft are illustrated partially in section.
Figure 7:
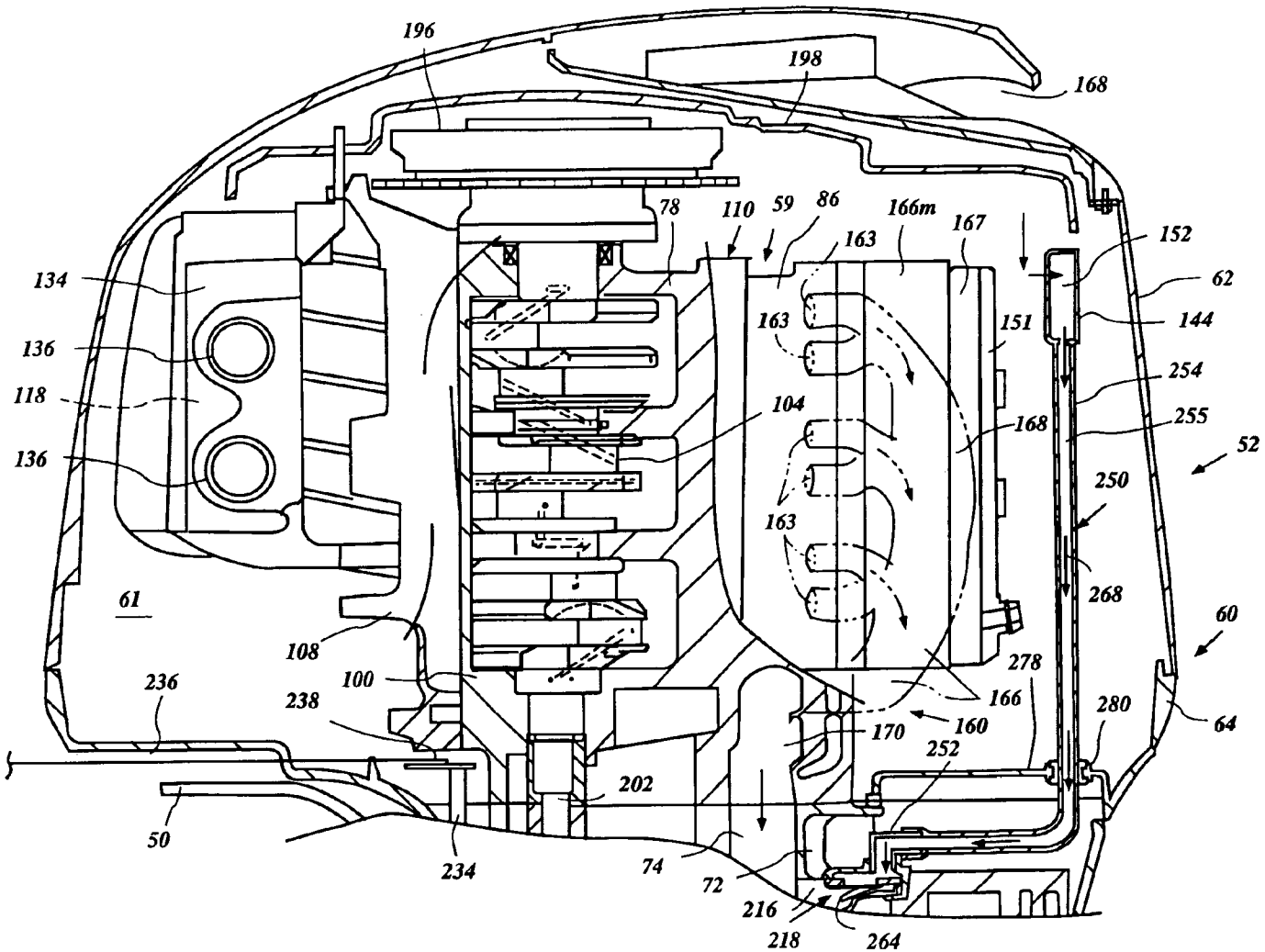
FIG. 7 is an enlarged side elevational and partial sectional view of the outboard motor shown in FIG. 6 to show a power head and particularly an engine of the outboard motor.

With reference to FIGS. 6 and 7, a modified arrangement of the air intake device 250 will be described. The same members, components and systems as those described above will be assigned with the same reference numerals and will not be described repeatedly.

In this modified arrangement, the upstream air passage 255 is not connected to the exhaust manifold passages 166. Instead, the upstream air conduit 254 defining the passage 255 extends downwardly through the bottom cowling member 64 and forwardly toward the idle exhaust inlet 218 of the exhaust guide member 72. A bracket portion 278 of the bottom cowling member 64 defines an aperture through which the upstream air conduit 254 passes. A grommet 280 is fitted into the aperture to support the conduit 254. The one-way valve unit 252 in this arrangement is positioned at the idle exhaust inlet 218 and is affixed to the exhaust guide member 72. The illustrated upstream air conduit 254 is coupled with the one-way valve 252.

In this arrangement, no downstream conduits 256 are necessary and only one conduit 254 can complete a passage connecting the secondary plenum chamber 152 and the exhaust system 160. Accordingly, the construction is quite simple. In addition, the one-way valve unit 252 is not exposed to the first section 214 of the primary exhaust pathway where majority of the heated exhaust gases flows. The one-way valve unit 252 thus is protected from the heat of the primary exhaust pathway.

Figure 8:
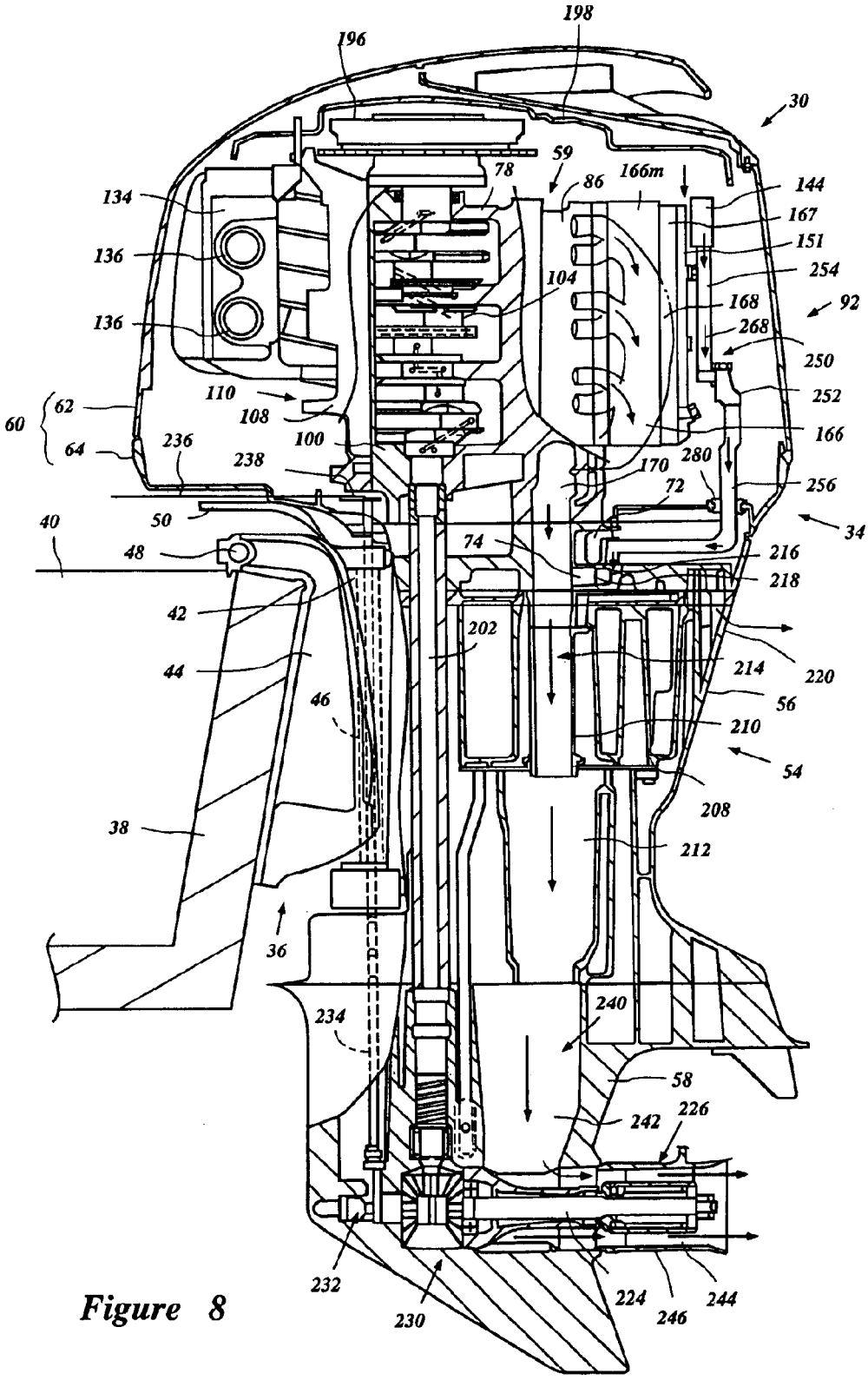
FIG. 8 is a side elevational view of a further modified outboard motor configured in accordance with a third preferred embodiment of the present invention. The outboard motor and an associated watercraft are illustrated partially in section.
Figure 9:
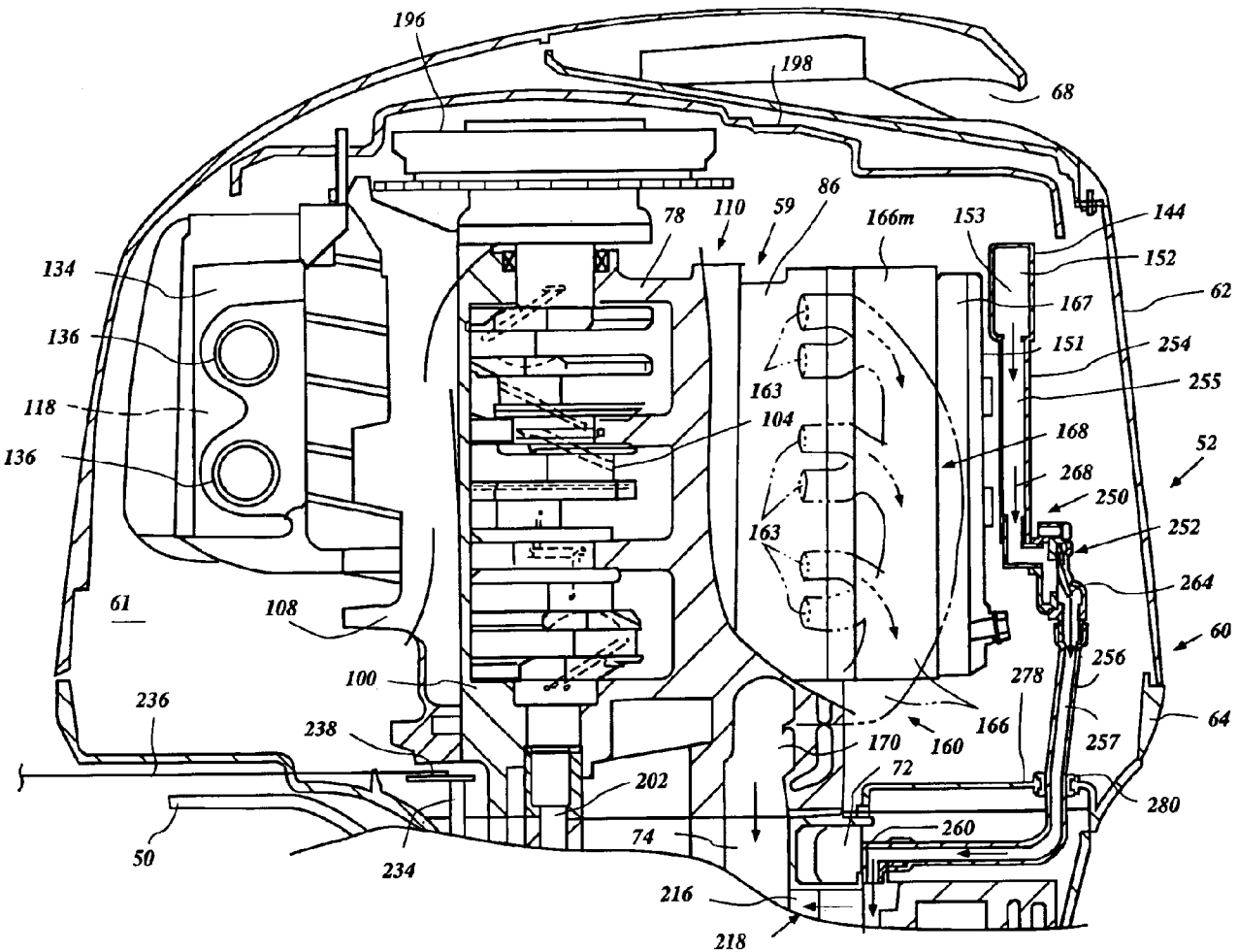
FIG. 9 is an enlarged side elevational and partial sectional view of the outboard motor shown in FIG. 8 to show a power head and particularly an engine of the outboard motor.

With reference to FIGS. 8 and 9, another modified arrangement of the air intake device 250 will be described. Again, the same members, components and systems as those described above will be assigned with the same reference numerals and will not be described repeatedly.

This arrangement is modified from both the first arrangement shown in FIGS. 1–5 and the second arrangement shown in FIGS. 6 and 7. That is, a single downstream air conduit 256 is coupled with the idle exhaust inlet 218 with the one-way valve unit 252 being positioned between the banks and on the outer exhaust cover member 151.

This arrangement needs only one downstream air conduit 256. Additionally, the exhaust guide member 72 is not necessitated to change greatly because the conduit 256, not the valve unit 252, is coupled herewith. The construction thus is simple and is not affected by the heat of the exhaust gases passing through the primary exhaust pathway.

Of course, the foregoing description is that of a preferred construction having certain features, aspects and advantages in accordance with the present invention. For instance, the downstream conduit of the air intake device can be connected to either the exhaust passage section of the cylinder block or the exhaust passage of the exhaust guide member in some arrangements. Accordingly, various changes and modifications may be made to the above-described arrangements without departing from the spirit and scope of the invention, as defined by the appended claims.

What is claimed is:

1. An outboard motor comprising a housing unit adapted to be mounted on an associated watercraft, an internal combustion engine disposed above the housing unit, the engine defining a first exhaust passage communicating with a combustion chamber of the engine, the housing unit defining a second exhaust passage communicating with the first exhaust passage, the second exhaust passage communicating with an outside of the outboard motor through an exhaust discharge port formed at a portion of the housing unit, a primary air delivery unit arranged to deliver air to the combustion chamber, the primary air delivery unit having a throttle valve, a secondary air delivery unit arranged to deliver supplemental air to the combustion chamber, the secondary air delivery unit coupled with a portion of the primary air delivery unit at a location downstream of the throttle valve, and an air intake device communicating with the secondary air delivery unit and either the first exhaust passage or the second exhaust passage, the air intake device including a one-way valve connected to the secondary air delivery unit and at least one of the first and second exhaust passages so as to allow at least a portion of the supplemental air to enter the first or second exhaust passage and to inhibit exhaust gases from moving beyond the one-way valve.

2. The outboard motor as set forth in claim 1, wherein the exhaust discharge port is arranged to be submerged when the outboard motor is in a propelling position of the associated watercraft.

3. The outboard motor as set forth in claim 1, wherein the exhaust discharge port is not submerged when the outboard motor is in a propelling position of the associated watercraft.

4. The outboard motor as set forth in claim 1, wherein the secondary air delivery unit includes a plenum chamber, the air intake device communicating with the plenum chamber.

5. The outboard motor as set forth in claim 1, wherein the secondary air delivery unit is configured to deliver the supplemental air to the combustion chamber at least when the primary air delivery unit delivers no air or almost no air to the combustion chamber.

6. The outboard motor as set forth in claim 4, wherein the plenum chamber is located adjacent to either the first or second exhaust passage.

7. The outboard motor as set forth in claim 1, wherein the engine comprises a plurality of cylinders, each cylinder defines a combustion chamber, the first exhaust passage being configured to guide exhaust gases from the combustion chambers, the air intake device being connected to the first exhaust passage.

8. The outboard motor as set forth in claim 1, wherein the engine comprises a plurality of cylinders, each cylinder defining a combustion chamber, the first exhaust passage being configured to guide exhaust gases from the combustion chambers, the second exhaust passage is configured to guide the exhaust gases to the exhaust discharge port, the air intake device being connected to the second exhaust passage.

9. The outboard motor as set forth in claim 1, wherein the one-way valve includes a reed valve.

10. The outboard motor as set forth in claim 1, wherein the engine comprises a plurality of cylinders, the cylinders are divided into two banks, spaced apart from each other, the secondary air delivery unit at least in part is generally disposed between the banks.

11. The outboard motor as set forth in claim 10, wherein the intake device additionally includes an air conduit connected to the one-way valve, the air conduit at least in part is generally disposed between the banks.

12. The outboard motor as set forth in claim 11, wherein the one-way valve is generally disposed between the banks.

13. The outboard motor as set forth in claim 1, wherein the one-way valve is disposed lower than the engine.

14. An outboard motor comprising a housing unit adapted to be mounted on an associated watercraft, an internal combustion engine disposed above the housing unit, the engine including an engine body defining a combustion chamber, a first air delivery system arranged to deliver air to the combustion chamber, the first air delivery system having a throttle valve, a second air delivery system arranged to deliver supplemental air to the combustion chamber, the second air delivery system connected to a portion of the first air delivery system at a location positioned downstream of the throttle valve, an exhaust system arranged to guide exhaust gases from the combustion chamber to outside through an exhaust discharge port formed at a portion of the housing unit, an air intake device communicating with the exhaust system and the second air delivery system, the air intake device including a one-way valve that allows a portion of the supplemental air to enter the exhaust system and inhibits the exhaust gases from moving beyond the one-way valve.

15. The outboard motor as set forth in claim 14, wherein the second air delivery system delivers the supplemental air to the combustion chamber at least when the first air delivery system delivers no air or little air to the combustion chamber.

16. The outboard motor as set forth in claim 14, wherein the engine body defines an inner exhaust passage, the air intake device is connected to the inner exhaust passage.

17. The outboard motor as set forth in claim 14, wherein the air intake device is connected to a portion of the exhaust system located outside of the engine body.

18. An outboard motor comprising a housing unit adapted to be mounted on an associated watercraft, an internal combustion engine disposed above the housing unit, the engine including an engine body defining a combustion chamber, an air induction system arranged to guide air to the combustion chamber, the air induction system including a plenum chamber, the air induction system comprising a primary air delivery unit and a secondary air delivery unit, the secondary air delivery unit delivering air to the combustion chamber when the primary air delivery unit delivers no air or almost no air to the combustion chamber, the secondary air delivery unit comprising the plenum chamber, an exhaust system arranged to guide exhaust gases from the combustion chamber to outside through an exhaust discharge port formed at a portion of the housing unit, an air intake device communicating with the exhaust system, the air intake device including a one-way valve that allows the air to enter the exhaust system and inhibits exhaust gases from moving beyond the one-way valve, the air intake device drawing the air from the plenum chamber, the exhaust discharge port including first and second outlets, the first outlet being submerged when the outboard motor is in a propelling position of the associated watercraft, the second outlet being not submerged when the outboard motor is in the propelling position of the associated watercraft, the exhaust system being divided into first and second sections, the first section being connected to the first outlet, the second section being connected to the second outlet, the air intake device being connected to the second section.

19. The outboard motor as set forth in claim 18, wherein the one-way valve is disposed at the second section.

20. The outboard motor as set forth in claim 14, wherein the one-way valve is affixed to the engine body.

21. The outboard motor as set forth in claim 14, wherein the air intake device is configured to deliver ample air to the exhaust system to overcome negative pressure in the exhaust system.

22. An outboard motor comprising a housing unit adapted to be mounted on an associated watercraft, an internal combustion engine disposed above the housing unit, the engine defining a combustion chamber therein, a first air delivery system arranged to deliver air to the combustion chamber, the first air delivery system having an air regulating device, a second air delivery system arranged to deliver supplemental air to the combustion chamber, the second air delivery system communicating with a portion of the first air delivery system at a location downstream of the regulating device, an exhaust system arranged to guide exhaust gases from the combustion chamber to outside through an exhaust discharge port formed at a portion of the housing unit, and means for delivering a portion of the supplemental air to the exhaust system when the exhaust system generates negative pressure.

23. An outboard motor comprising an internal combustion engine that has a combustion chamber, a first air delivery system that delivers air to the combustion chamber, the first air delivery system having an air regulating device, a second air delivery system that delivers supplemental air to the combustion chamber, the second air delivery system communicating with a portion of the first air delivery system at a location downstream of the regulating device, an exhaust system that routes exhaust gases from the combustion chamber, and a third air delivery system that delivers a portion of the supplemental air to the exhaust system when the exhaust system generates a negative pressure.

24. The outboard motor as set forth in claim 23, wherein the second air delivery system has a plenum chamber, and the third air delivery system is connected to the plenum chamber.

25. The outboard motor as set forth in claim 23, wherein the third air delivery system has a one-way valve that allows the supplemental air to move to the exhaust system and inhibits exhaust gas flow into the second air delivery system.

26. An outboard motor comprising an internal combustion engine that has an engine body, the engine body defining a combustion chamber, a first air delivery system that delivers air to the combustion chamber, an exhaust system that routes exhaust gases from the combustion chamber, and a second air delivery system that delivers supplemental air to the combustion chamber, the second air delivery system supplying a portion of the supplemental air to the exhaust system when the exhaust system generates a negative pressure, wherein the first air delivery system has at least one plenum chamber disposed generally on a first side of the engine body, the second air delivery system at least in part is positioned on a second side of the engine body that is different from the first side.

27. The outboard motor as set forth in claim 26, wherein the engine has a crankshaft, and the second side is a side positioned oppositely to the first side relative to the crankshaft.

28. An outboard motor comprising an internal combustion engine that has an engine body, the engine body defining a combustion chamber, a first air delivery system that delivers air to the combustion chamber, the first air delivery system having at least one plenum chamber disposed generally on a first side of the engine body, an exhaust system that routes exhaust gases from the combustion chamber, a second air delivery system that delivers air to the exhaust system when the exhaust system generates a negative pressure, the second air delivery system not receiving the air supplied to the exhaust system from the first air delivery system, and a third air delivery system that delivers third air to the combustion chamber, the first air delivery system having a regulating device, the third air delivery system connected to a portion of the first- air delivery system downstream of the regulating device, and the second air delivery system is connected to the third air delivery system upstream of where the third air delivery system is connected to the portion of the first air delivery system.

29. The outboard motor as set forth in claim 28, wherein the third air delivery system has a second plenum chamber.

30. The outboard motor as set forth in claim 28, wherein the third air delivery system has a second plenum chamber, and the second air delivery system is arranged to receive air from the second plenum chamber.

* * * * *

UNITED STATES PATENT AND TRADEMARK OFFICE

CERTIFICATE OF CORRECTION

PATENT NO. : 6,921,307 B2
APPLICATION NO. : 10/153249
DATED : July 26, 2005
INVENTOR(S) : Yukinori Kashima et al.

It is certified that error appears in the above-identified patent and that said Letters Patent is hereby corrected as shown below:

At column 4, line 10, please delete "repair person" and insert -- repairperson --, therefor.

At column 10, line 24, after "below." please delete "100641".

At column 10, lines 25-42, please delete "When the operator……..into the exhaust system 160." and insert the same as a new paragraph on line 26.

At column 13, line 10, in Claim 10, please delete "banks," and insert -- banks --, therefor.

At column 16, line 5, in Claim 28, please delete "first-air" and insert -- first air --, therefor.

Signed and Sealed this

Twenty-ninth Day of April, 2008

JON W. DUDAS
*Director of the United States Patent and Trademark Office*